United States Patent [19]

Blaskowski

[11] 4,193,158

[45] Mar. 18, 1980

[54] SOOT BLOWER FOR PRESSURIZED FURNACE

[75] Inventor: Henry J. Blaskowski, West Simsbury, Conn.

[73] Assignee: Combustion Engineering, Inc., Windsor, Conn.

[21] Appl. No.: 1,342

[22] Filed: Jan. 5, 1979

[51] Int. Cl.[2] ..... F23J 3/00; F27D 23/00

[52] U.S. Cl. ..... 15/317

[58] Field of Search ..... 15/316 R, 316 A, 317, 15/318

[56] References Cited

U.S. PATENT DOCUMENTS

| | | | |
|---|---|---|---|
| 1,128,406 | 2/1915 | Burgess | 15/317 |
| 1,645,307 | 10/1927 | Snow | 15/318 |
| 1,681,165 | 8/1928 | Bayer et al. | 15/318 |
| 3,816,871 | 6/1974 | Karnofsky | 15/317 |

*Primary Examiner*—Christopher K. Moore
*Attorney, Agent, or Firm*—Wayne H. Lang

[57] ABSTRACT

A reciprocable soot blower that is adapted to extend laterally through an outer wall to remove deposits of slag that collect on the walls of a pressurized furnace, gasifier or other reactor. The soot blower is telescopically mounted in a conduit attached to an outside wall of the furnace to permit its complete withdrawal from the furnace when not in use. A steam seal is adapted to be activated in the conduit when the soot blower is extended to increase pressure in the conduit to thus prevent entry of foreign material from said furnace into the space between the conduit and the soot blower.

9 Claims, 3 Drawing Figures

SOOT BLOWER FOR PRESSURIZED FURNACE

BACKGROUND OF THE INVENTION

Soot blowers have long been used to remove deposits of slag and other foreign material that collect on the walls of a gasifier, furnace or other type reactor. Typically, a soot blower is mounted at the side of the gasifier and then moved laterally through an opening in a wall thereof to eject a blast of cleaning fluid over the surface of the walls or other elements to be cleaned. Excessive pressure within the gasifier is prevented from flowing into the soot blower by a protective seal or gland that separates relatively movable parts.

Examples of this type apparatus are shown by the following art: U.S. Pat. No. 3,140,503; U.S. Pat. No. 1,183,417; and U.S. Pat. No. 1,709,167.

If the interior pressure of the gasifier should exceed that of the soot blowing mechanism, the high pressure gas from the gasifier carrying foreign material therein will slowly enter the soot blowing mechanism to cause abrasion of the parts, and heat of the gasifier will cause rapid degeneration of the protective seal.

SUMMARY

The present invention therefore provides a soot blower for use in a pressurized gasifier or furnace in which slagging residues are commonly deposited on the walls thereof, and periodic removal of such slagging is effected to maintain continuous effective operation. The invention provides further for a pressurized sealing arrangement that maintains fluid pressure in a soot blower above that in said furnace whereby furnace gases and slag carried thereby will not be permitted to flow into said soot blower to cause excessive abrasion or erosion of the several parts.

Figure 1:
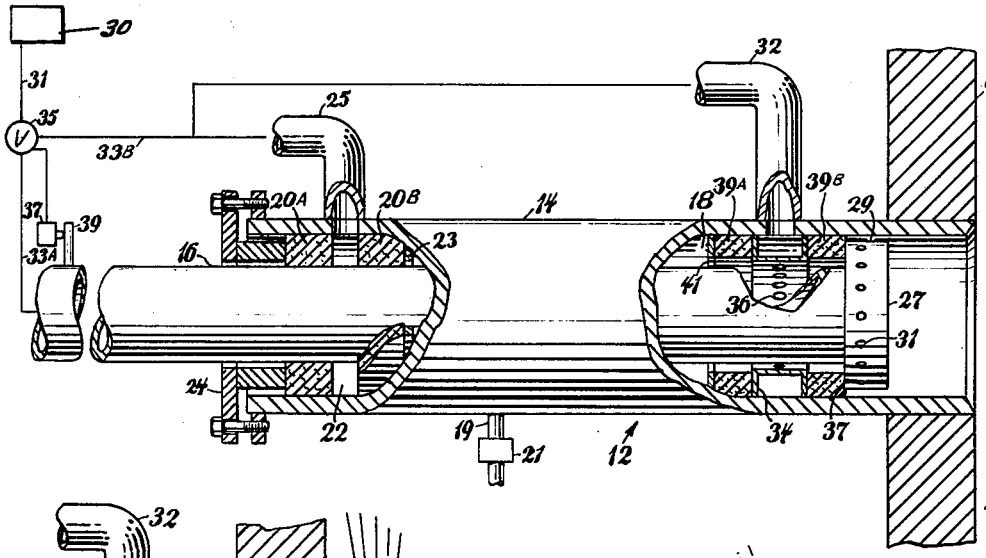
FIG. 1 is a longitudinal section with parts broken away to show the construction of the soot blower.
Figure 2:
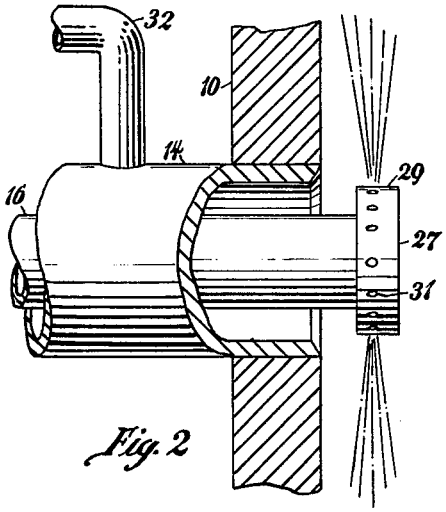
FIG. 2 is a partial longitudinal view of the device of FIG. 1 in an extended position.

In the drawing, the numeral 10 identifies the wall of a furnace, gasifier or other type reactor that may contain an operating pressure of from several atmospheres to 1000 psig. The walls are usually cooled by a conventional system of waterwall tubing that causes solidification of molten slag on the walls of the furnace. In order that slag deposits may be removed from the furnace walls before they adversely affect the operation thereof, soot blowers shown generally at 12 are adapted to eject a blast of cleaning fluid over the furnace walls to loosen the deposits for eventual removal.

The soot blowers each comprise an outer conduit 14 that is secured as by welding normal to the furnace wall 10. A second or inner conduit 16 is positioned concentrically within the first conduit to provide an annular space 18 therebetween. The annular space is provided with an outlet 19 including a conventional steam trap 21 to prevent the build-up of steam therein. The inner conduit is supported for longitudinal movement therein by a seal that comprises two annular sections 20A and 20B, spaced apart to provide a sealing space 22. The space 22 is provided with an inlet 25 connected to a source of pressurized fluid 30 whereby pressurized fluid may be supplied to the space 22 to produce a back pressure therein that acts against the pressure in the furnace or in the annular space 18, to thus prevent leakage therefrom. The forward section 20B of the seal rests against a shoulder 23 on the inner periphery of conduit 14, while the rear section 20A is held by an adjustable packing gland 24 to provide the annular sealing space 22 therebetween. This seal 20 may be a lantern seal such as seal 34 described hereinafter.

A cylindrical head 27 is affixed to an end of the inner conduit 16 whereby reciprocation of conduit 16 will position the head inside the furnace or inside the conduit 14. The head 27 includes an imperforate circular surface and an adjacent annular surface 29 having a plurality of openings 31 therein adapted to confront the inner wall of the outer conduit 14. A source of pressurized fluid 30 is adapted to be supplied to the open end of conduit 16 for exhaust from the apertures 31 in the cylindrical head. The flow of fluid from source 30 through passageway 31 to branch lines 33A and 33B is controlled by a valve 35. The valve 35 is operated by a switch 37 activated by removal of the arm 39 on the horizontally movable inner conduit 16.

The inner conduit 16 may be moved axially either manually or automatically to control the flow of pressurized fluid from the source to the inner conduit 16. Maximum flow will occur when the inner conduit 16 and head 27 thereon is moved forward into the furnace so that fluid may exhaust unimpeded on to the furnace walls. When the inner conduit and head thereon are withdrawn completely into the outer conduit 14, some pressurized fluid (steam) will continue to exhaust through the openings 31 and confront the wall of the tube 14 thereby building up pressure in the annulus 18 to exclude furnace gases and entrained particular matter therefrom.

However, when the inner conduit 16 is moved to a forward position with head 27 lying within the furnace, high pressure furnace gases would be free to enter the conduit 14 and the annulus 18 in back of the cylindrical head 27. To prevent this, there is provided lantern seal means for introducing steam or other pressurized fluid into the annulus 18. Accordingly, an inlet duct 32 is adapted to supply pressurized fluid to an annular lantern seal distributor 34 with peripheral openings 36 to create sufficient back pressure therein to prevent furnace gas from entering the annulus 18. The annular distributor 34 is bracketed by an annular packing means 39A that is held in the rear by a shoulder 41 on the inner surface of conduit 14, and by an annular packing 39B that has a seat formed on the forward side thereof. By excluding the high pressure furnace gases, the slag and other particulate matter entrained therein is also prevented from entering annulus 18, and the walls consequently remain essentially clean, and degradation of the annular lantern seal 20 is essentially eliminated.

When the inner conduit 16 is moved to its retracted position within the outer conduit 14, the head 27 is withdrawn to lie against an annular face 37 of distributor 34, thus producing a positive seal that precludes furnace gas from entering the annular space that lies between the annular distributor 34 and the lantern packing 18. Accordingly, when the conduit 16 is in a withdrawn condition, the pressurized gas supply at 25 and 32 may be terminated while still excluding high pressure furnace gas from the soot blower.

Figure 3:
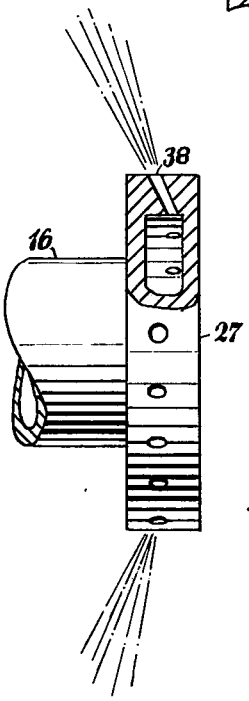
FIG. 3 is a slightly modified form of apparatus.

One or more of the lateral openings in the head 27 may be inclined rearwardly in the manner shown by openings 38 of FIG. 3 to exhaust the fluid flowing therefrom directly on to the walls of the furnace, thus producing a more effective cleaning arrangement.

The pressurized fluid applied to the inner conduit 16, the space 22 in the lantern seal, and to the annular distributor 34 may be from the same or different sources of supply, it only being necessary that the pressure fluid be clean and at a pressure that is in excess of that within the furnace. Furthermore, the flow of pressurized steam or other fluid to the soot blower 16 and to the adjacent ducts 25 and 36 may be regulated in any desired sequence by a system of conventional regulating valves whose control comprises no part of this invention.

What is claimed is:

1. A soot blower for removal of slag from the walls of a reactor containing pressurized gases, said soot blower comprising a conduit affixed to a wall of the reactor and adapted to extend outward therefrom, a second conduit concentrically positioned within the first conduit to provide an annular space therebetween, means supporting the second conduit for longitudinal movement within the first conduit, a cylindrical head affixed to an end of the second conduit having an imperforate end face with an apertured cylindrical periphery that is adapted to lie adjacent the inner cylindrical wall of the first cylindrical conduit, a source of pressurized fluid, means connecting the source of pressurized fluid to the second conduit for exhaust from the apertures of the cylindrical head, means for moving the second conduit longitudinally within the first conduit to move the apertured head into the reactor and exhaust fluid therefrom, and means for supplying a quantity of pressurized fluid to the annular space that lies between the first and second conduits to exclude foreign matter therefrom.

2. A soot blower as defined in claim 1 wherein the means for supplying a quantity of pressurized fluid to the annular space between the first and second conduits comprises an annular distributor having radial passageways therethrough concentrically spaced around the second conduit to permit fluid flow between the annular distributor and the annular space.

3. A soot blower as defined in claim 2 wherein the annular distributor is formed with a lateral seat that receives the head of the second conduit when said second conduit is withdrawn within the first conduit thereby precluding the flow of slag from said furnace into the annular space.

4. A soot blower as defined in claim 3 wherein the means supporting the second conduit for longitudinal movement within the first conduit comprises axially spaced annular members.

5. A soot blower as defined in claim 4 including means for injecting pressurized fluid between axially spaced annular members.

6. A soot blower as defined in claim 5 wherein apertures in the cylindrical head are directed reversely to project pressurized fluid toward the reactor walls.

7. A soot blower as defined in claim 6 wherein the pressurized fluid comprises pressurized steam.

8. A soot blower as defined in claim 7 including means that activates the flow of pressurized steam when the imperforate head is moved from its seat.

9. A soot blower as defined in claim 8 wherein the pressure of the pressurized steam exceeds that of the pressurized gases within the reactor.

* * * * *